US009351350B2

(12) United States Patent
Jeong et al.

(10) Patent No.: US 9,351,350 B2
(45) Date of Patent: May 24, 2016

(54) MULTI-ELECTRODE FIELD EMISSION DEVICE HAVING SINGLE POWER SOURCE AND METHOD OF DRIVING SAME

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR); Jae-Woo Kim, Daejeon (KR); Jun-Tae Kang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 121 days.

(21) Appl. No.: 14/283,755

(22) Filed: May 21, 2014

(65) Prior Publication Data

US 2014/0346975 A1 Nov. 27, 2014

(30) Foreign Application Priority Data

May 24, 2013 (KR) ..... 10-2013-0059025
Feb. 27, 2014 (KR) ..... 10-2014-0023415

(51) Int. Cl.
*H05B 41/36* (2006.01)
*H05B 33/08* (2006.01)
*H01J 1/304* (2006.01)

(52) U.S. Cl.
CPC ..... *H05B 33/08* (2013.01); *H01J 1/304* (2013.01)

(58) Field of Classification Search
CPC ..... H01J 31/00; H05B 33/08
See application file for complete search history.

(56) References Cited

U.S. PATENT DOCUMENTS 3,521,073 A * 7/1970 Taylor ..... H01S 5/30 250/552
5,259,799 A * 11/1993 Doan ..... H01J 9/025 445/24
6,081,246 A * 6/2000 Cathey ..... G09G 3/22 315/169.3
8,692,226 B2 * 4/2014 Cheatham, III ..... H01J 29/02 257/10
2007/0171152 A1 * 7/2007 Iguchi ..... G09G 3/22 345/75.2
2007/0278925 A1 * 12/2007 Mao ..... B82Y 10/00 313/311

(Continued)

FOREIGN PATENT DOCUMENTS

KR 10-2001-0043899 A 5/2001
KR 10-2010-0108720 A 10/2010

(Continued)

*Primary Examiner* — Jason M Crawford
*Assistant Examiner* — Kurtis R Bahr
(74) *Attorney, Agent, or Firm* — Rabin & Berdo, P.C.

(57) ABSTRACT

A field emission device and a method of driving the multi-electrode field emission device having a single driving power source are disclosed. The field emission device includes a cathode electrode, one or more gate electrodes, a voltage division unit, and a power source unit. The cathode electrode is figured such that at least one emitter is formed thereon. The gate electrodes are disposed between an anode electrode and the cathode electrode, and each have one or more openings through which electrons emitted from the emitter can pass. The voltage division unit has one or more divider resistors, and divides a voltage applied from the power source unit using the divider resistors and then applies partial voltages to the one or more gate electrodes. The power source unit includes a single power source, and applies the voltage to the voltage division unit.

16 Claims, 11 Drawing Sheets

(56) References Cited

U.S. PATENT DOCUMENTS

2010/0136869 A1* 6/2010 Aoki ..... H01J 1/304 445/24
2010/0244717 A1 9/2010 Jeong et al.
2011/0074309 A1* 3/2011 Jeong ..... H05B 33/0896 315/291
2011/0080093 A1* 4/2011 Walton ..... H01J 3/025 315/111.21
2011/0080435 A1* 4/2011 Sasaguri ..... C09K 11/7789 345/690

FOREIGN PATENT DOCUMENTS

KR 10-2011-0033762 A 3/2011
WO WO-99/63413 A1 12/1999

* cited by examiner

MULTI-ELECTRODE FIELD EMISSION DEVICE HAVING SINGLE POWER SOURCE AND METHOD OF DRIVING SAME

CROSS-REFERENCE TO RELATED APPLICATIONS

This application claims the benefit of Korean Patent Application Nos. 10-2013-0059025 and 10-2014-0023415, filed May 24, 2013 and Feb. 27, 2014, respectively, which are hereby incorporated by reference herein in their entirety.

BACKGROUND OF THE INVENTION

1. Technical Field

The present disclosure relates to a multi-electrode field emission device having a single driving power source and a method of driving the multi-electrode field emission device having a single driving power source.

2. Description of the Related Art

Field emission devices are devices that enable electrons to be emitted from an emitter formed on a cathode electrode by commonly applying an electric field to the cathode electrode. Field emission devices may be classified into diode field emission devices for applying an electric field to a cathode emitter by using voltage applied to an anode, and collecting emitted electrons using the anode; and triode field emission devices for making electrons to be emitted from a cathode by using voltage applied to a gate electrode, and accelerating electrons having passed through the gate electrode using voltage applied to an anode. Although one or more electrodes may be added in order to provide one or more additional functions, such as the function of focusing an electron beam, the same operating principle of making electrons be emitted from an emitter formed on a cathode electrode by applying an electric field to the cathode is employed.

Korean Patent Application Publication No. 10-2010-0108720 discloses a field emission device and a method of driving the field emission device. A common triode field emission device is driven using a gate power source for controlling field emission current and an anode power source for determining the acceleration voltage of emitted electrons, and thus requires at least two driving power sources.

SUMMARY OF THE INVENTION

Accordingly, at least one embodiment of the present invention is intended to provide a three or more-electrode field emission device having a single driving power source and a method of driving the field emission device.

In accordance with an aspect of the present invention, there is provided a field emission device, including a cathode electrode configured such that at least one emitter is formed thereon; one or more gate electrodes disposed between an anode electrode and the cathode electrode, and each configured to have one or more openings through which electrons emitted from the emitter can pass; a voltage division unit configured to have one or more divider resistors and to divide a voltage applied from a power source unit using the divider resistors and then apply partial voltages to the one or more gate electrodes; and the power source unit configured to include a single power source and to apply the voltage to the voltage division unit.

The field emission device may further include a current control unit electrically connected to the cathode electrode and configured to control a cathode current flowing through the cathode electrode.

The current control unit may include a control signal generation unit configured to input a control signal operative to control the cathode current to the current switching unit; and a current switching unit configured to selectively turn on and off the cathode current in response to the control signal.

The control signal may be a low voltage pulse signal or a direct current (DC) signal in the range of 0 to 5 V.

The current switching unit may include a transistor configured such that the power source is connected to a source terminal thereof, the cathode electrode is connected to a drain terminal thereof and the control signal is input to a gate terminal thereof.

The current switching unit may include a variable resistor connected to a gate terminal of a first transistor and configured to control the voltage of the control signal input to a second transistor; the first transistor configured such that the power source is connected to a source terminal thereof, a source terminal of the second transistor is connected to a drain terminal thereof and the variable resistor is connected to a gate terminal thereof; and the second transistor configured such that the drain terminal of the first transistor is connected to the source terminal thereof, the cathode electrode is connected to a drain terminal thereof and the control signal whose voltage has been controlled by the variable resistor is input to a gate terminal thereof.

The first transistor may be a low voltage transistor, and the second transistor may be a high voltage transistor.

The voltage division unit may further include a divider resistor configured to divide the voltage applied from the power source unit and then apply a partial voltage to the control signal generation unit.

The control signal generation unit may include a wireless communication unit, and may receive the control signal from the outside via the wireless communication unit and input the control signal to the current switching unit.

The single power source may be a negative power source, and the anode electrode may be grounded.

The values of the divider resistors may be arbitrary values that meet both a first condition that a voltage applied to the gate electrode should be higher than a minimum required gate voltage and a second condition that during the current control of the current control unit, the cathode voltage should not be higher than the allowable voltage of the current control unit.

The values of the divider resistors may be values that belong to the values meeting the first and second conditions and that make the sum of the resistance values of the divider resistors maximum.

In accordance with another aspect of the present invention, there is provided a method of driving a field emission device, including setting the resistance values of one or more divider resistors of a voltage division unit; applying a voltage to the voltage division unit using a single power source of a power source unit; dividing, by the voltage division unit, the applied voltage, and then applying, by the voltage division unit, partial voltages to one or more gate electrodes; and controlling, by a current control unit, a cathode current flowing through a cathode electrode in response to a control signal.

Setting the resistance values of the one or more divider resistors may include calculating values that meet both a first condition that a voltage applied to the gate electrode should be higher than a minimum required gate voltage and a second condition that during the current control of the current control unit, the cathode voltage should not be higher than the allowable voltage of the current control unit; and selecting arbitrary values from among the calculated values.

Selecting the arbitrary values may include selecting values that belong to the values meeting the first and second conditions and that make a sum of the resistance values of the divider resistors maximum.

The control signal may be a low voltage pulse signal or a direct current (DC) signal in the range of 0 to 5 V.

Setting the resistance values of the divider resistors may include, if the single power source of the field emission device is a negative power source and also an anode electrode is grounded, receiving, by a current control unit, the control signal from the outside via wireless communication.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
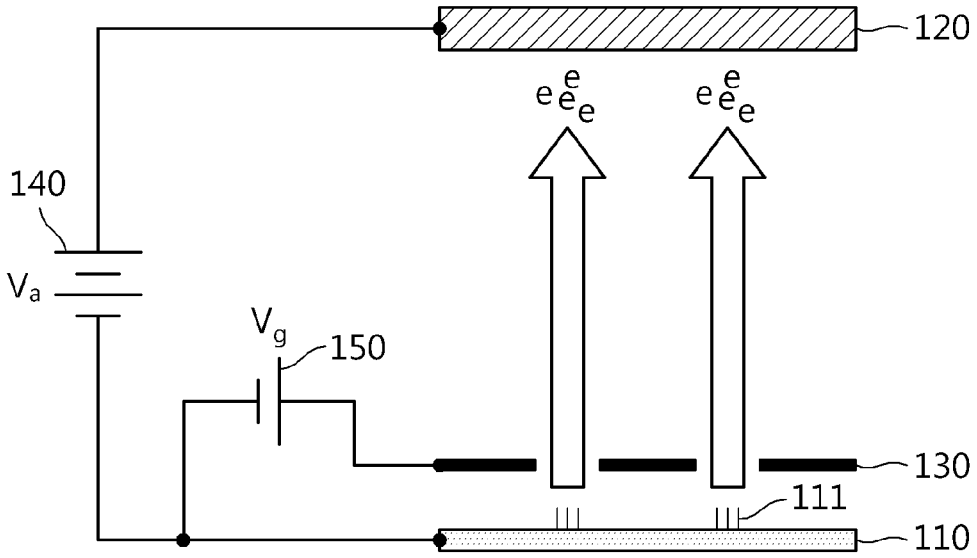
FIG. 1 illustrates an example of a common triode field emission device.

Reference now should be made to the drawings, throughout which the same reference numerals are used to designate the same or similar components.

Multi-electrode field emission devices having a single power source and a method for driving the same according to embodiments of the present invention are described in detail below with reference to the accompanying drawings.

FIG. 1 illustrates an example of a common triode field emission device.

Referring to FIG. 1, the common triode field emission device includes a cathode electrode 110, an anode electrode 120, and a gate electrode 130. In this case, an emitter 111 is formed on the cathode electrode 110.

The common field emission device is configured such that electrons are emitted by applying an electric field to the emitter 111 formed on the cathode electrode 110 based on voltage applied to the gate electrode 130 and the emitted electrons pass through the holes of the gate electrode 130 and are accelerated by voltage applied to the anode electrode 110.

Meanwhile, the common triode field emission device of FIG. 1 requires at least two driving power sources, that is, a gate power source 150 for controlling field-emitted current and an anode power source 140 for determining the acceleration voltage of the emitted electrons, as illustrated.

Figure 2:
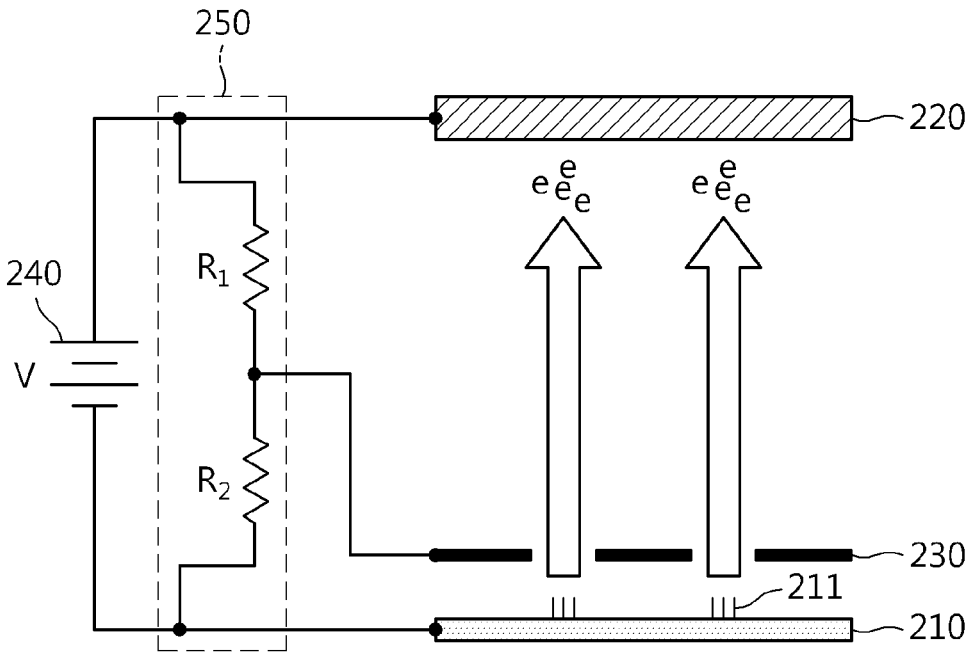
FIG. 2 illustrates a field emission device according to an embodiment of the present invention.

FIG. 2 illustrates a field emission device according to an embodiment of the present invention.

Referring to FIG. 2, the field emission device according to this embodiment of the present invention may include a cathode electrode 210, an anode electrode 220, a gate electrode 230, an emitter 211 formed on the cathode electrode 210, a power source unit 240, and a voltage division unit 250.

The power source unit 240 includes a single driving power source, and applies power between the cathode electrode 210 and the anode electrode 220.

The voltage division unit 250 divides the voltage applied between the cathode electrode 210 and the anode electrode 220 by the power source unit 240 using divider resistors $R_1$ and $R_2$, and applies a resulting partial voltage to the gate electrode 230.

Accordingly, using the single driving power source of the power source unit 240, a triode or four or more-electrode field emission device may be driven, and a field emission device having a simple structure may be constructed. In contrast, it is relatively difficult to control the voltage applied to the gate electrode, and thus it may be difficult to control field-emission current as desired.

Various embodiments of a field emission device capable of facilitating the control of voltage applied to a gate electrode will be described with reference to FIG. 3 to FIG. 11.

Figure 3:
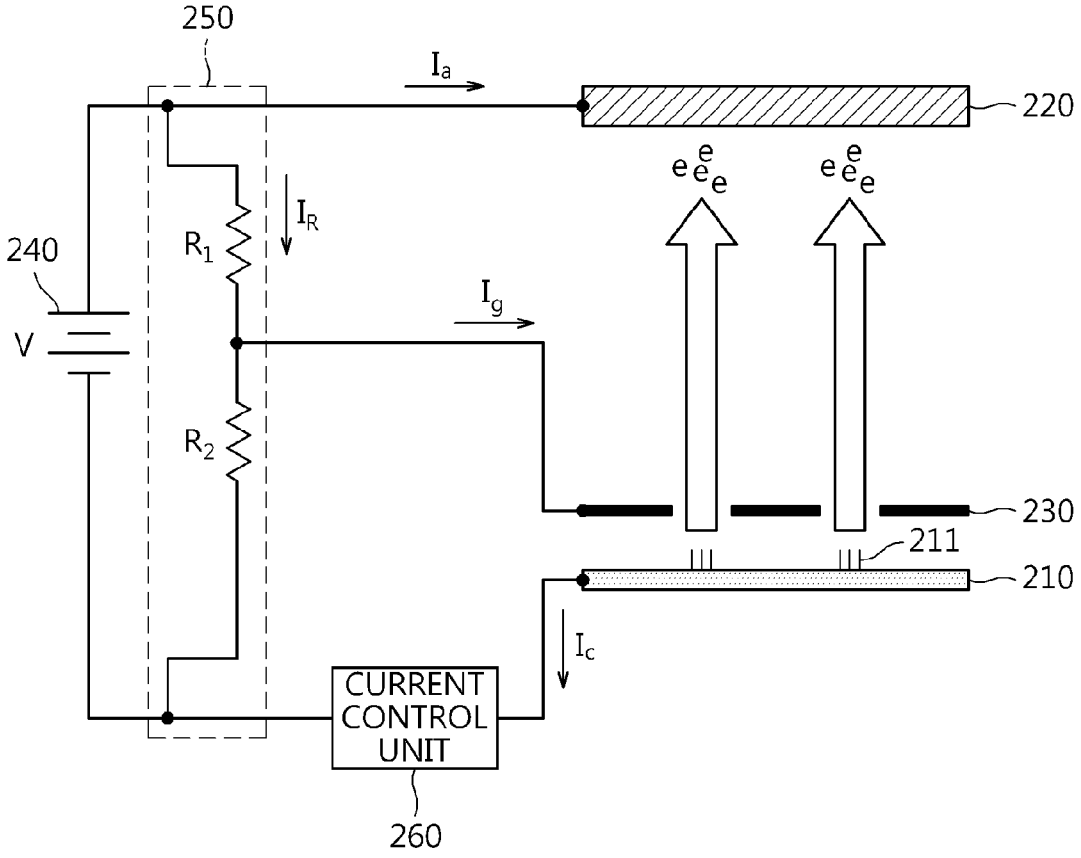
FIG. 3 illustrates a field emission device according to another embodiment of the present invention.
Figure 4:
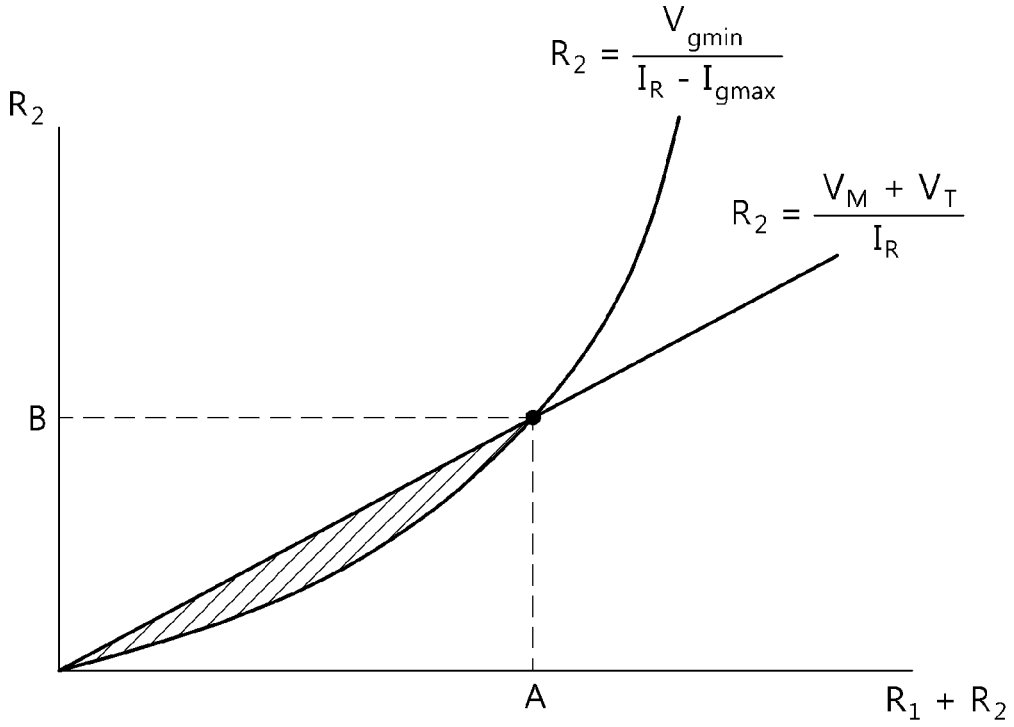
FIG. 4 is a graph illustrating the divider resistors of a field emission device according to an embodiment of the present invention.

FIG. 3 illustrates a field emission device according to another embodiment of the present invention. FIG. 4 is a diagram illustrating the divider resistors of a field emission device according to an embodiment of the present invention.

Referring to FIG. 3, the field emission device may include a cathode electrode 210, an anode electrode 220, a gate electrode 230, an emitter 211 formed on the cathode electrode 210, a power source unit 240, and a voltage division unit 250. Furthermore, the field emission device may further include a current control unit 260 configured to facilitate the control of voltage applied to the gate electrode 210.

Voltage V is applied between the cathode electrode 210 and the anode electrode 220 by the single driving power source of the power source unit 240.

The voltage division unit 250 divides the applied voltage V using the divider resistors $R_1+R_2$, and applies a resulting partial voltage to the gate electrode 230. In this case, an anode voltage $V_a$ applied to the anode electrode 220 and a gate voltage $V_g$ applied to the gate electrode 230 may be expressed using the following Equation 1:

$$V_a = V$$

$$V_g = V - (V/(R_1+R_2) - I_g)R_2 \quad (1)$$

That is, the gate voltage $V_g$ is defined by the voltage drop of the divider resistor $R_2$ attributable to a current obtained by subtracting a current $I_g$ leaked to the gate electrode 230 from a current flowing through series resistors $R_1+R_2$.

If the anode voltage $V_a$ applied to the anode electrode 220 and the gate voltage $V_g$ applied to the gate electrode 230 are constant over time, the magnitude of an electron beam, that is, a cathode current, emitted from the emitter 211 formed on the cathode electrode 210 may be determined by the control of the current control unit 260 connected in series to the cathode electrode 210.

For example, if 100% of an electron beam emitted from the cathode electrode 210 reaches the anode electrode 220 when electric field emission occurs, there is no leakage current of the gate electrode 230, in which case the gate voltage $V_g$ may be expressed by the following Equation 2:

$$V_g = VR_1/(R_1+R_2) \quad (2)$$

However, generally, there is current leakage from the gate electrode 230, and thus a voltage lower than the maximum gate voltage $V_g$ of Equation 2 is actually applied to the gate electrode 230. Accordingly, in order to apply a gate voltage sufficient for electric field emission, it is necessary to set the divider resistors $R_1+R_2$ of the voltage division unit 250 to values suitable for the field emission device in advance.

FIG. 4 is a graph illustrating the divider resistors of a field emission device according to an embodiment of the present invention. A method of determining the values of the divider resistors suitable for the field emission device is described with reference to FIG. 4.

First, if the minimum required gate voltage is $V_{g\ min}$, the maximum gate leakage current is $I_{g\ max}$, the allowable voltage of the current control unit 260 connected to the cathode electrode 210 is $V_M$, and a gate voltage at which electric field emission starts is $V_T$, the relations of the following Equations 3 to 5 are established:

$$R_1 + R_2 < \frac{V}{I_{gmax}} \quad (3)$$

$$\frac{V_{gmin}}{I_R - I_{gmax}} < R_2 \quad (4)$$

$$R_2 \leq \frac{V_M + V_T}{I_R} \quad (5)$$

In this case, $I_R$ is the function of $R_1+R_2$. Equation 3 may be derived from the condition that a current flowing through the divider resistors should be higher than the maximum gate leakage current $I_{g\ max}$, Equation 4 may be derived from the condition that a voltage applied to the gate electrode 230 should be higher than the minimum required gate voltage $V_{g\ min}$, and Equation 5 may be derived from the condition that during the current control of the current control unit 260, the cathode voltage of the cathode electrode 210 should not increase to a value equal to or higher than the allowable voltage $V_M$ of the current control unit 260.

In this case, arbitrary values that meet the first condition of Equation 4 and the second condition of Equation 5 may be determined to be divider resistor values. That is, a hatched region in the graph of FIG. 4 is a region that meets both the first and second conditions, and it may be possible to select arbitrary $R_1$ and $R_2$ from the hatched region and determine the values of the selected $R_1$ and $R_2$ to be the divider resistor values of the field emission device.

However, since current leakage occurs due to the divider resistors, it may be preferable to select the highest combination of the values $R_1+R_2$ that is, the resistance values at the intersection between two functions on the graph of FIG. 4, as the divider resistor values. The values $R_1$ and $R_2$ at the intersection A on the graph of FIG. 4 and the value $R_2$ at point B may be obtained using the following Equations 6 and 7. In this case, Equation 6 may be derived from the condition that Equations 4 and 5 are identical to each other, and Equation 7 may be derived from Equation 4.

$$R_1 + R_2 = \frac{V(V_M + V_T - V_{gmin})}{(V_M + V_T)I_{gmax}} \quad (6)$$

$$R_2 = \frac{V_{gmin}}{I_R - I_{gmax}} \quad (7)$$

For example, if a field emission device in which V is 5 kV, the maximum electric field emission current is 4 mA, the gate leakage current is 10%, that is, 0.4 mA, the minimum required gate voltage is 2 k and an electric field emission start voltage is 500 V is driven, the divider resistor values $R_1$ and $R_2$ may be determined to be about 1.67 MΩ and about 2.49 MΩ using Equations 6 and 7, respectively, when the allowable voltage of the current control unit 260 is 2.5 kV.

If the divider resistor values are determined using Equations 6 and 7 and are determined to be determined divider resistor values as described above, desired driving characteristics may be obtained from the field emission device.

Figure 5:
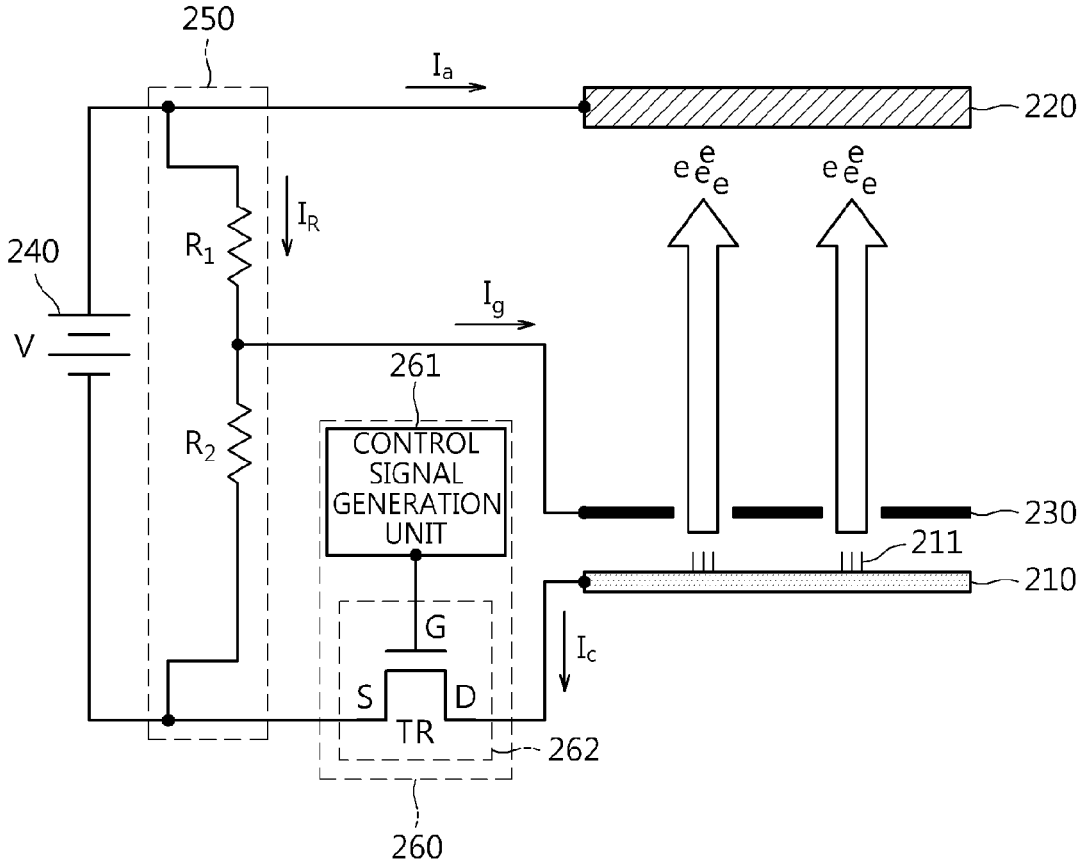
FIG. 5 is a diagram illustrating an embodiment of the current control unit of the field emission device of FIG. 3.

FIG. 5 is a diagram illustrating an embodiment of the current control unit of the field emission device of FIG. 3.

Referring to FIG. 5, the field emission device according to this embodiment of the present invention may include a cathode electrode 210, an anode electrode 220, a gate electrode 230, an emitter 211 formed on the cathode electrode 210, a power source unit 240, a voltage division unit 250 and a current control unit 260 in the same manner. In the following description, detailed descriptions of configurations identical to those of the above-described field emission device are omitted.

In this case, the current control unit 260 may include a control signal generation unit 261 and a current switching unit 262, as illustrated in FIG. 5.

The control signal generation unit 261 inputs a control signal operative to control a cathode current flowing through the cathode electrode 210 to the current switching unit 262. In this case, the control signal may be a low voltage pulse signal or a DC signal in the range from 0 to 5 V.

The current switching unit 262 may perform on/off control on the cathode current in response to a control signal input from the control signal generation unit 261.

The current switching unit 262 includes a field effect transistor TR, and may control the cathode current using the field effect transistor TR. In this case, the transistor TR may be a high voltage MOSFET capable of bearing a high voltage. The single driving power source of the power source unit 240 is connected to the source terminal S of the field effect transistor TR, the cathode electrode 210 is connected to the drain terminal D thereof, and the control signal generation unit 261 is connected to gate terminal G thereof, so that a control signal is input to the field effect transistor TR.

Figure 6:
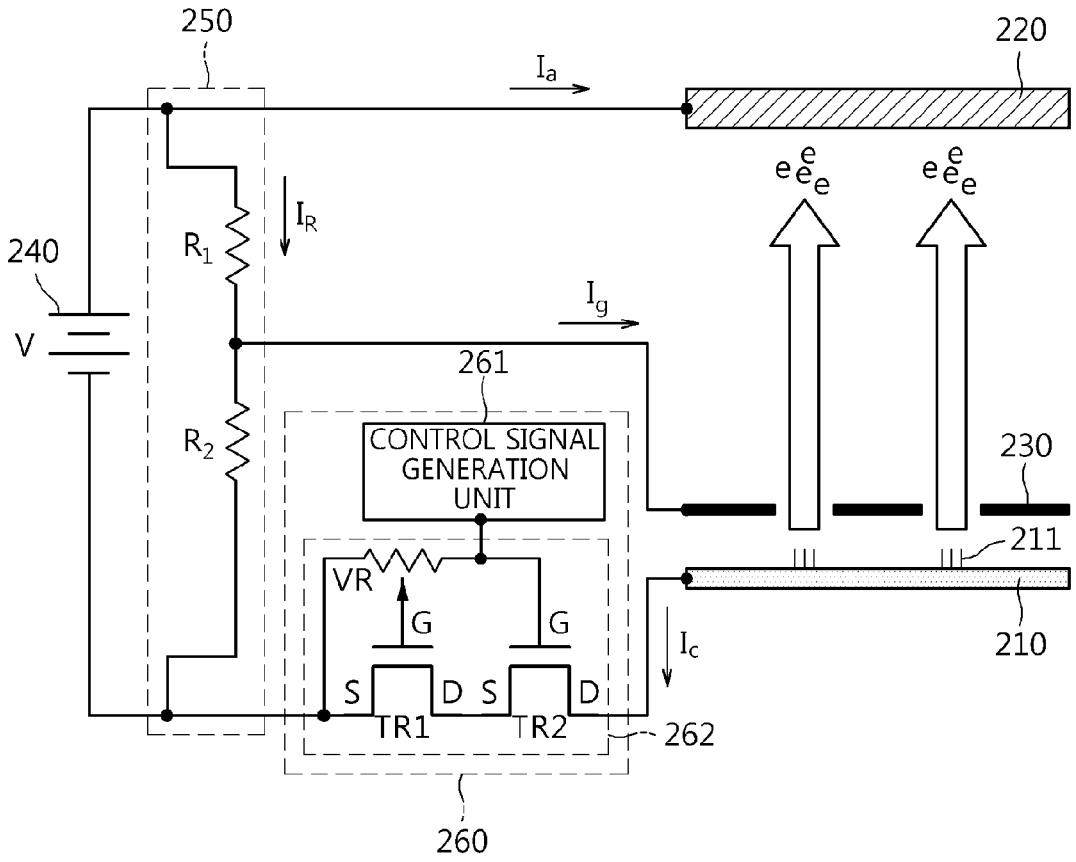
FIG. 6 is a diagram illustrating another embodiment of the current control unit of the field emission device of FIG. 3.

FIG. 6 is a diagram illustrating another embodiment of the current control unit of the field emission device of FIG. 3.

As illustrated in FIG. 6, the field emission device according to this embodiment of the present invention may include a cathode electrode 210, an anode electrode 220, a gate electrode 230, an emitter 211 formed on the cathode electrode 210, a power source unit 240, a voltage division unit 250, and a current control unit 260. In the following description, detailed descriptions of configurations identical to those of the above-described field emission devices are omitted.

Referring to FIG. 6, the current control unit 260 of the field emission device includes a control signal generation unit 261 and a current switching unit 262. In this case, the current switching unit 262 may include two transistors, that is, a first transistor TR1 and a second transistor TR2, and a variable resistor VR. Current control characteristics may be improved by using the two transistors TR1 and TR2.

In this case, the first transistor TR1 may be a low voltage MOSFET having excellent current control characteristics. The single driving power source of the power source unit 240 is connected to the source terminal S of the first transistor TR1, the source terminal S of the second transistor TR2 is connected to the drain terminal D thereof, and the variable resistor VR is connected to the gate terminal G thereof. The first transistor TR1 may control a cathode current by making a relatively low voltage signal lower than a control signal input from the control signal generation unit 261 be input using the variable resistor VR connected to the gate terminal G.

Furthermore, the second transistor TR2 may be a high voltage MOSFET capable of bearing a high voltage when the cathode voltage increases. The drain terminal D of the first transistor TR1 is connected to the source terminal S of the second transistor TR2, the cathode electrode 210 is connected to the drain terminal D thereof, and a control signal whose voltage has been controlled by the variable resistor is input to the gate terminal G thereof.

Figure 7:
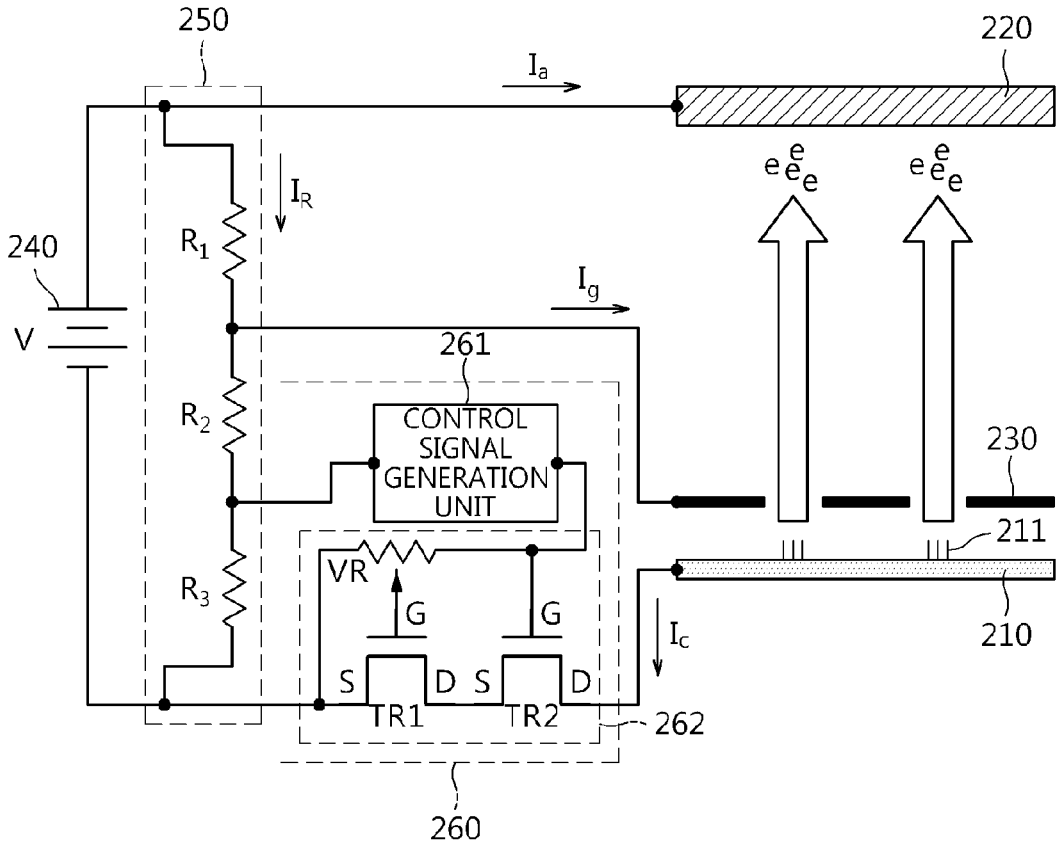
FIG. 7 is a diagram illustrating still another embodiment of the current control unit of the field emission device of FIG. 3.

FIG. 7 is a diagram illustrating still another embodiment of the current control unit of the field emission device of FIG. 3.

Referring to FIG. 7, the field emission device according to this embodiment of the present invention may include a cathode electrode 210, an anode electrode 220, a gate electrode 230, an emitter 211 formed on the cathode electrode 210, a power source unit 240, a voltage division unit 250, and a current control unit 260. The current control unit 260 may include a control signal generation unit 261 and a current switching unit 262. The current switching unit 262 may include one or more transistors TR1 and TR2 and a variable resistor VR. In the following description, detailed descriptions of configurations identical to those of the above-described field emission devices are omitted.

The control signal generation unit 261 of the current control unit 260 may be supplied with power from an external power source or a battery other than the single driving power source of the power source unit 240. Furthermore, as illustrated in FIG. 7, the voltage division unit 250 may further include a divider resistor $R_3$, and may divide a voltage applied from the single driving power source of the power source unit 240 using the added divider resistor $R_3$ and then apply a partial voltage to the control signal generation unit 261.

In this case, although not illustrated in FIG. 7, the control signal generation unit 261 may further include a voltage regulator in order to enable stable voltage supply regardless of voltage fluctuation attributable to a gate leakage current.

Figure 8:
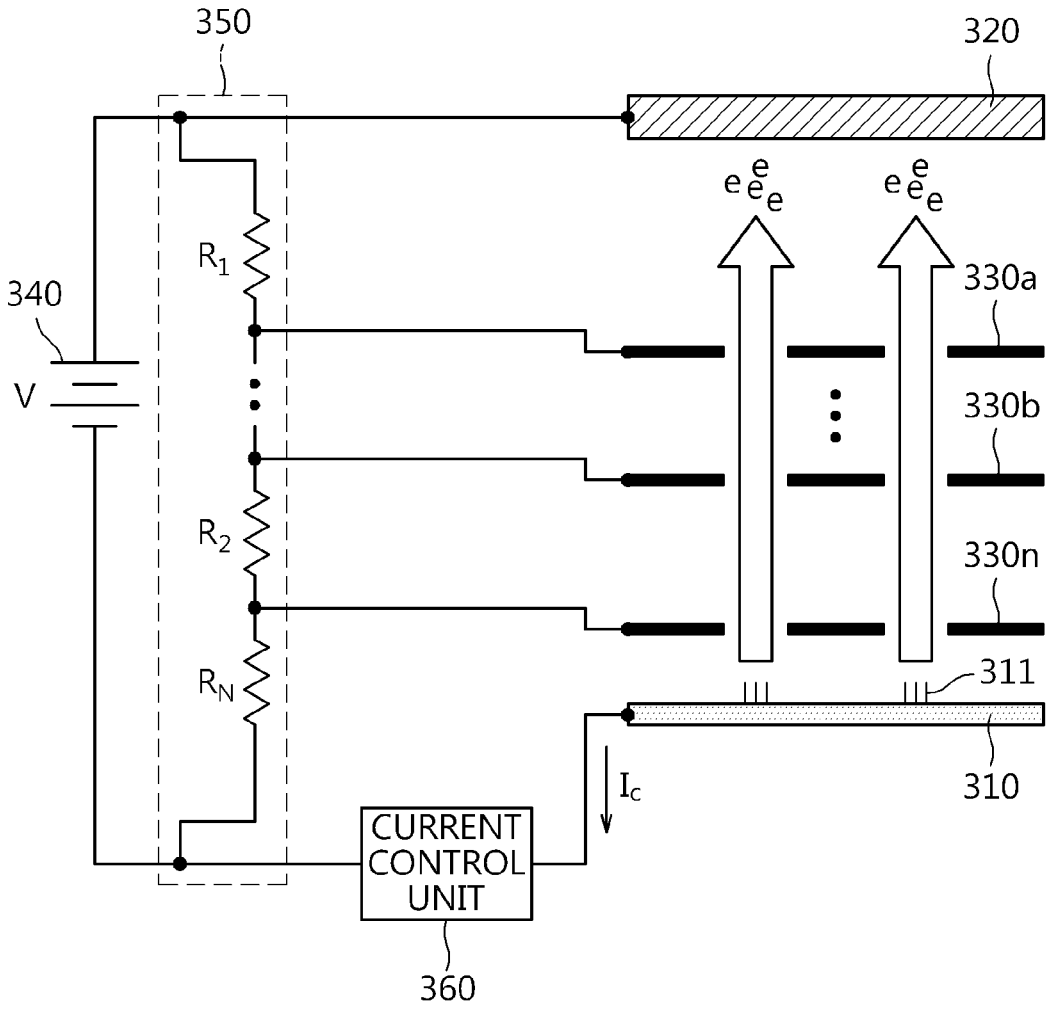
FIG. 8 is a diagram of a multi-electrode field emission device according to an embodiment of the present invention.

FIG. 8 is a diagram of a multi-electrode field emission device according to an embodiment of the present invention.

Referring to FIG. 8, the multi-electrode field emission device according to this embodiment of the present invention may include a cathode electrode 310, an anode electrode 320, an emitter 311 formed on the cathode electrode 310, a power source unit 340, a voltage division unit 350, and a current control unit 360. In the following description, detailed descriptions of configurations identical to those of the above-described field emission devices are omitted.

Furthermore, the multi-electrode field emission device according to this embodiment of the present invention may include two or more gate electrodes 330*a*, 330*b*, . . . , 330*n*. Furthermore, the field emission device according to this embodiment of the present invention may include two or more divider resistors $R_1, R_2, \ldots, R_N$ in order to divide power applied from the single driving power source of the power source unit 340 and then apply partial voltages to the two or more gate electrodes 330*a*, 330*b*, . . . , 330*n*.

The multi-electrode field emission device according to this embodiment of the present invention can obtain divider resistor values in the same principle as the above-described method of determining divider resistor values in a triode field emission device, and set the obtained divider resistor values, thereby achieving desired driving characteristics.

Figure 9:
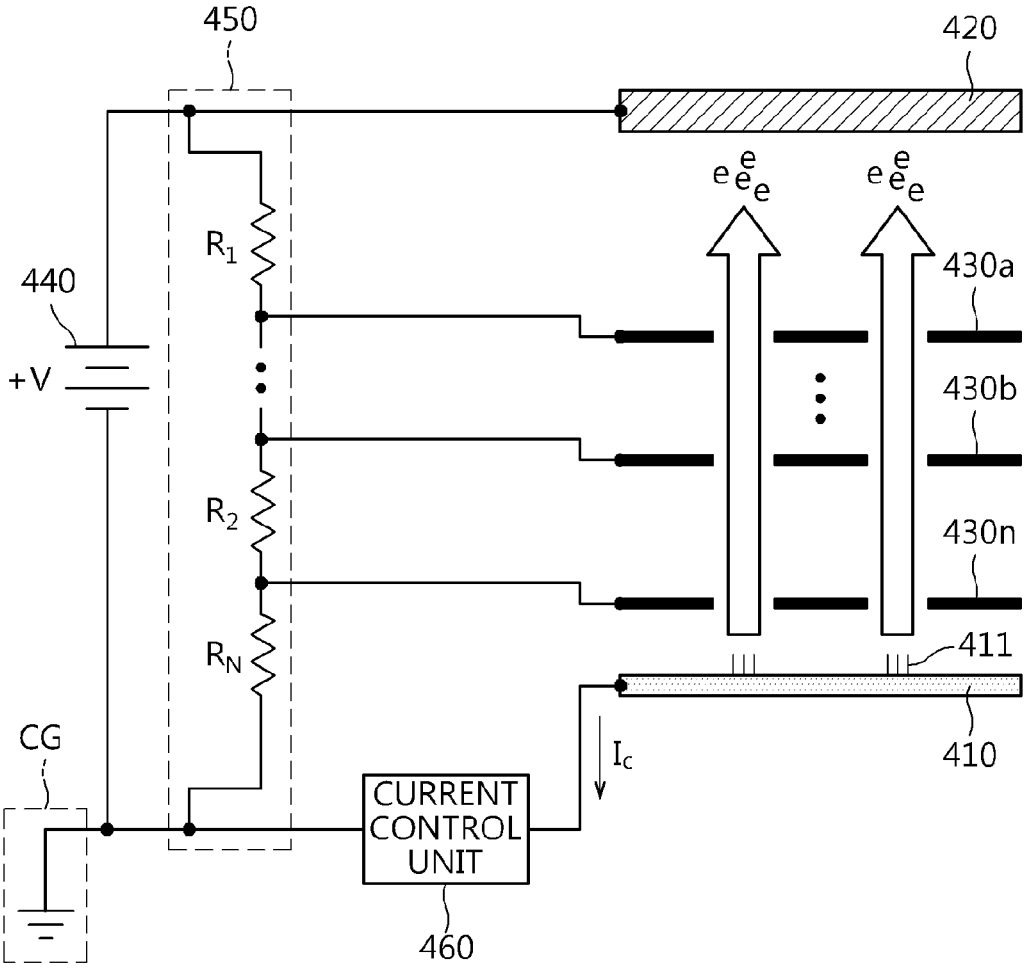
FIGS. 9 and 10 are diagrams illustrating the single driving power sources of field emission devices.
Figure 10:
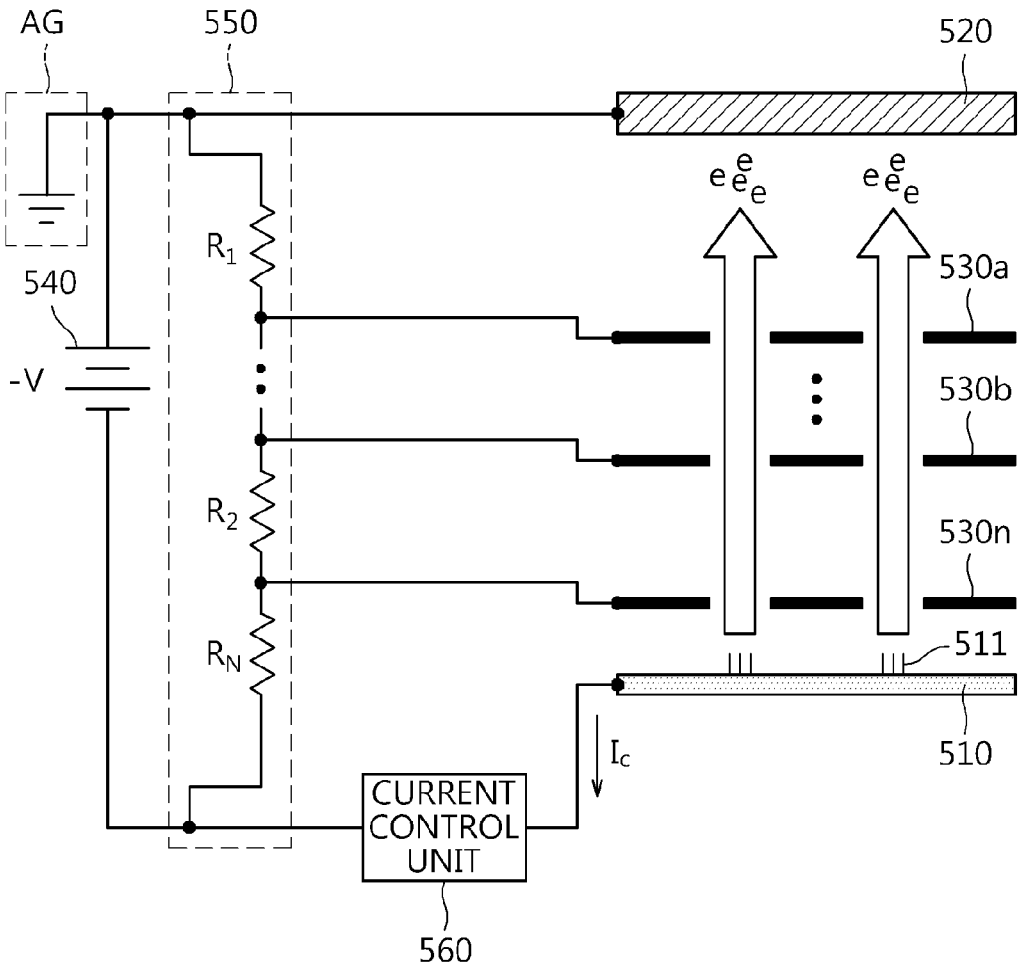

FIGS. 9 and 10 are diagrams illustrating the single driving power sources of field emission devices.

As illustrated in FIGS. 9 and 10, each of these field emission devices may include a cathode electrode 410 or 510, an anode electrode 420 or 520, one or more gate electrodes 330*a* to 330*n* or 440*a* to 440*b*, a power source unit 440 or 540, a voltage division unit 450 or 550, and a current control unit 460 or 560. Furthermore, an emitter 411 or 511 may be formed on the cathode electrode 410 or 510. In the following description, detailed descriptions of configurations identical to those of the above-described field emission devices are omitted.

Referring to FIGS. 9 and 10, in each of these field emission devices, the single driving power source of the power source unit 440 may be a positive power source, as illustrated in FIG. 9. That is, when the cathode electrode 410 is grounded (CG), the anode electrode 420 becomes a positive high voltage side and is driven by the positive voltage source.

Furthermore, the single driving power source of the power source unit 540 becomes a negative power source, as illustrated in FIG. 10. That is, as illustrated in FIG. 10, when the anode electrode 520 is grounded (AG), the cathode electrode 510 becomes a negative high voltage side, and this negative driving may be usefully used for an X-ray source and the like in which an anode electrode is grounded.

Figure 11:
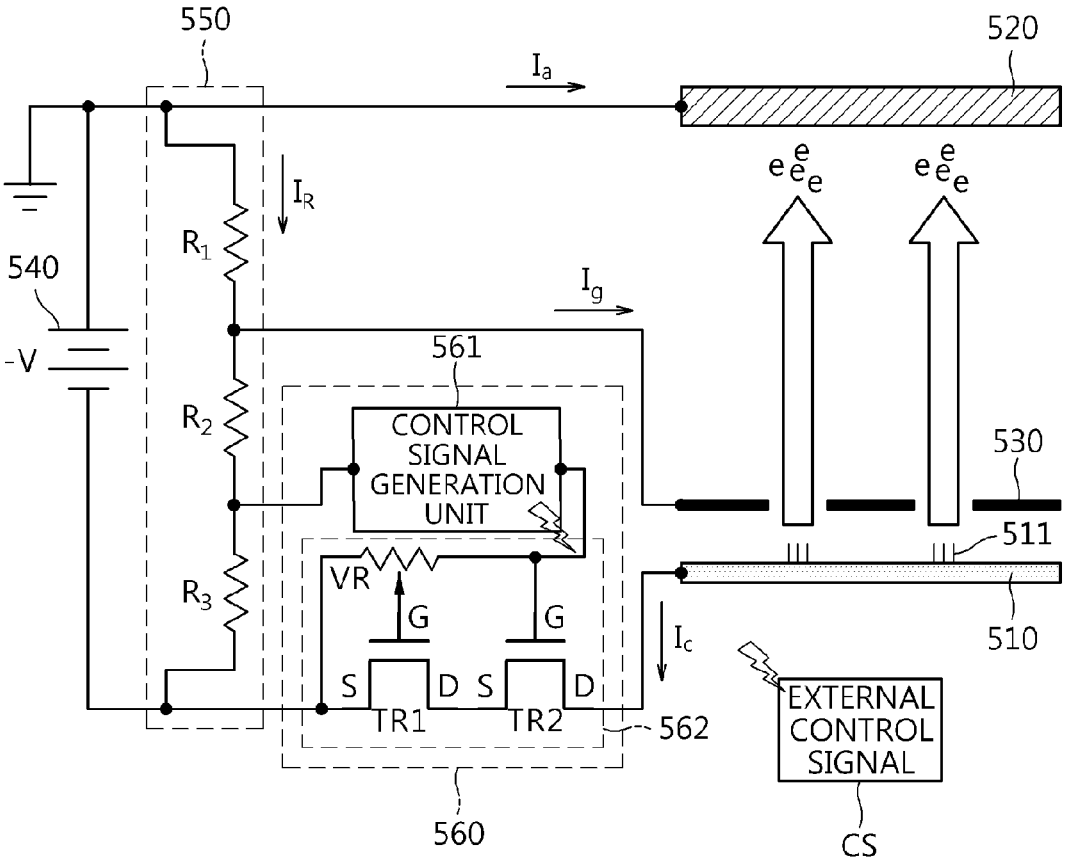
FIG. 11 is a diagram illustrating the current control unit of the field emission device of FIG. 10.

FIG. 11 is a diagram illustrating the current control unit of the field emission device of FIG. 10.

Referring to FIG. 11, the field emission device may include a cathode electrode 510, an anode electrode 520, a gate electrode 530, a power source unit 540, a voltage division unit 550, and a current control unit 560. Furthermore, an emitter 511 may be formed on the cathode electrode 510. In the following description, detailed descriptions of configurations identical to those of the above-described field emission devices are omitted.

The control signal generation unit 561 of the current control unit 560 may include a wireless communication unit that is not illustrated in FIG. 11. The wireless communication unit may receive a control signal CS from the outside via wireless communication. When the wireless communication unit receives a control signal CS from the outside, the control signal generation unit 561 may control a cathode current by inputting the control signal CS to the switching unit 562. In this case, as illustrated in FIG. 11, the current switching unit 562 may include one or more transistors TR1 and TR2 or a variable resistor VR.

Accordingly, when the anode electrode 520 is grounded and thus the single driving power source of the power source unit 540 becomes a negative high voltage, the problem in which it is difficult to directly receive an external control signal due to a problem, such as insulation, can be overcome.

Figure 12:
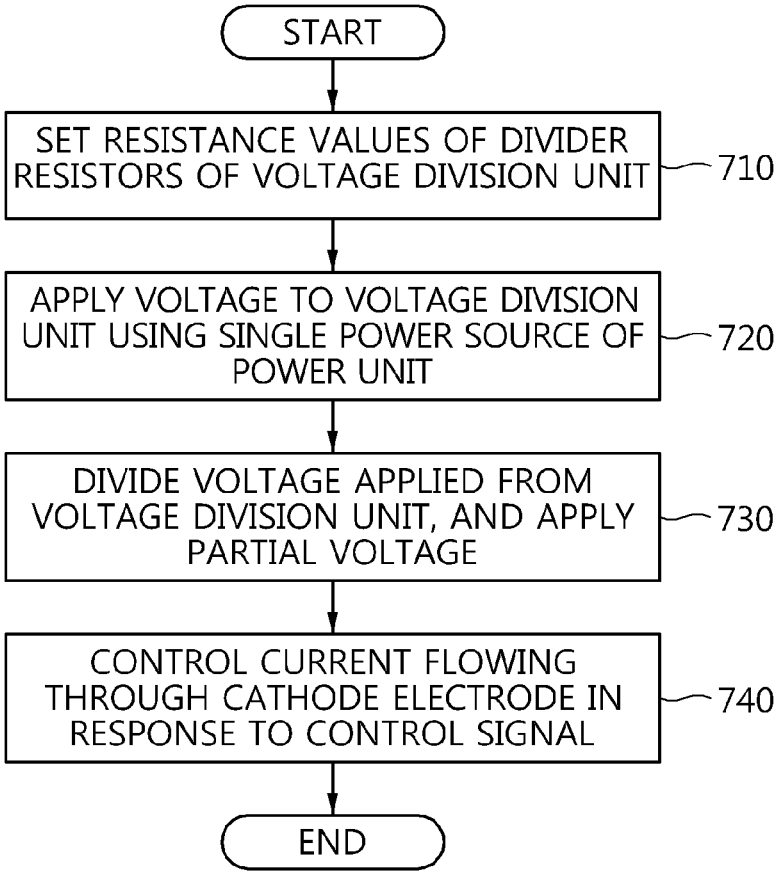
FIG. 12 illustrates a method of driving a multi-electrode field emission device having a single driving power source according to an embodiment of the present invention.

FIG. 12 illustrates a method of driving a multi-electrode field emission device having a single driving power source according to an embodiment of the present invention.

The method of driving a multi-electrode field emission device having a single driving power source according to an embodiment of the present invention is described below with reference to FIG. 12.

First, the values of divider resistors included in the voltage division unit of the field emission device are set in advance at step 710. In this case, the values of the divider resistors may be determined by the above-described equations.

Step 710 may include the step of calculating values that meet both the first condition of Equation 4 in which the voltage applied to the gate electrode should be higher than the minimum required gate voltage and the second condition of Equation 5 in which during the current control of the current control unit, the cathode voltage should not be higher than the allowable voltage of the current control unit, and the step of selecting arbitrary values from among the calculated values. In this case, the step of selecting arbitrary values may include the step of selecting values that belong to the values meeting the first and second conditions and that make the sum of the resistance values of the divider resistors maximum.

Thereafter, when power is applied to the voltage division unit by the single driving power source of the power source unit at step 720, the voltage division unit divides the applied voltage using the divider resistors and applies partial voltages to the one or more gate electrodes at step 730.

Thereafter, the current control unit controls the cathode current flowing through the cathode electrode in response to a control signal input from the outside at step 740. In this case, the current control unit may control the cathode current using the control signal generation unit and the current switching unit configured to include one or more transistors and control the cathode current in response to a control signal, as described in detail above. Furthermore, the control signal may be a low voltage pulse signal or a DC signal in the range from 0 to 5 V.

Furthermore, at step 740, if the single power source of the field emission device is a negative power source and the anode electrode is grounded, the current control unit may receive a control signal from the outside via wireless communication, and may control the cathode current using the received control signal.

In accordance with at least one embodiment, a three or more-electrode field emission device can be driven using a single voltage source and, in particular, current control can be performed even in the case of negative high voltage driving in which an anode electrode is grounded.

Although the preferred embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A field emission device, comprising:

an anode electrode;

a cathode electrode configured such that at least one emitter is formed thereon;

a power source unit including a single power source;

a voltage division unit, including two divider resistors connected in series, configured to divide a voltage applied from the power source unit using the two divider resistors to generate a partial voltage;

a gate electrode disposed between the anode electrode and the cathode electrode, the gate electrode having one or more openings through which electrons emitted from the at least one emitter pass, the gate electrode being electrically connected to a connection point at which the two divider resistors are connected, the partial voltage generated by the voltage division unit being supplied via the connection point to the gate electrode as a gate voltage; and a current control unit electrically connected between the cathode electrode and the voltage division unit and configured to control a cathode current flowing through the cathode electrode for controlling the partial voltage.

2. The field emission device of claim 1, wherein the current control unit comprises:

a control signal generation unit configured to input a control signal operative to control the cathode current; and a current switching unit configured to selectively turn on and off the cathode current in response to the control signal.

3. The field emission device of claim 2, wherein the control signal is a low voltage pulse signal or a direct current (DC) signal in a range of 0 to 5 V.

4. The field emission device of claim 2, wherein the current switching unit comprises a transistor configured such that the power source is connected to a source terminal thereof, the cathode electrode is connected to a drain terminal thereof and the control signal is input to a gate terminal thereof.

5. The field emission device of claim 2, wherein the voltage division unit further comprises an additional divider resistor configured to divide the voltage applied from the power source unit and apply a partial voltage to the control signal generation unit.

6. The field emission device of claim 2, wherein the control signal generation unit comprises a wireless communication unit, and receives the control signal from an outside via the wireless communication unit and inputs the control signal to the current switching unit.

7. The field emission device of claim 6, wherein the single power source is a negative power source, and the anode electrode is grounded.

8. The field emission device of claim 2, wherein values of the divider resistors are arbitrary values that meet both a first condition that a voltage applied to the gate electrode is higher than a minimum required gate voltage and a second condition that during current control of the current control unit, the cathode voltage is not higher than an allowable voltage of the current control unit.

9. The field emission device of claim 8, wherein the values of the divider resistors are values that belong to the values meeting the first and second conditions and that maximize a sum of the resistance values of the divider resistors.

10. A field emission device comprising:

a cathode electrode configured such that at least one emitter is formed thereon;

one or more gate electrodes disposed between an anode electrode and the cathode electrode, and each configured to have one or more openings through which electrons emitted from the at least one emitter pass;

a power source unit including a single power source;

a voltage division unit including one or more divider resistors connected in series, configured to divide a voltage applied from the power source unit using the divider resistors and apply partial voltages to the one or more gate electrodes; and a current control unit electrically connected to the cathode electrode and configured to control a cathode current flowing through the cathode electrode, the current control unit including a control signal generation unit configured to input a control signal operative to control the cathode current, and a current switching unit configured to selectively turn on and off the cathode current in response to the control signal, the current switching unit including a variable resistor connected to a gate terminal of a first transistor and configured to control a voltage of the control signal input to a second transistor, the first transistor configured such that the power source is connected to a source terminal thereof, a source terminal of the second transistor is connected to a drain terminal thereof and the variable resistor is connected to a gate terminal thereof, and the second transistor configured such that the drain terminal of the first transistor is connected to the source terminal thereof, the cathode electrode is connected to a drain terminal thereof and the control signal whose voltage has been controlled by the variable resistor is input to a gate terminal thereof.

11. The field emission device of claim 10, wherein the first transistor is a low voltage transistor, and the second transistor is a high voltage transistor.

12. A method of driving a field emission device that includes a single power source, a cathode electrode and an anode electrode, a voltage division unit, including a plurality of divider resistors, connected between the cathode and anode electrodes, a gate electrode electrically connected to a connection point at which two of the divider resistors are connected, and a current control unit electrically connected between the cathode electrode and the voltage division unit, comprising:

applying a voltage to the voltage division unit using the single power source;

dividing, by the divider resistors, a voltage applied from the single power source to generate a partial voltage, and applying, by the voltage division unit, the partial voltage via the connection point to the gate electrode as a gate voltage; and controlling, by a current control unit, a cathode current flowing through the cathode electrode for controlling the partial voltage to be supplied to the gate electrode as the gate voltage.

13. The method of claim 12, wherein setting the resistance values of the divider resistors comprises:

calculating values that meet both a first condition that a voltage applied to the gate electrode is higher than a minimum required gate voltage and a second condition that during the current control of the current control unit, the cathode voltage is not higher than the allowable voltage of the current control unit; and selecting arbitrary values from among the calculated values.

14. The method of claim 13, wherein selecting the arbitrary values comprises selecting values that belong to the values meeting the first and second conditions and that maximize a sum of the resistance values of the divider resistors.

15. The method of claim 12, wherein controlling the cathode current includes generating a control signal that is a low voltage pulse signal or a direct current (DC) signal in a range of 0 to 5 V to control the partial voltages to be supplied to the gate electrode as the gate voltage.

16. The method of claim 12, further comprising setting the single power source to a negative power source and connecting the anode electrode to ground, wherein setting the resistance values of the divider resistors comprises receiving, by the current control unit, a control signal from an outside via wireless communication, and setting the resistance values using the received control signal by controlling the cathode current to control the partial voltages to be supplied to the gate electrode as the gate voltage.

* * * * *